US010801717B2

(12) United States Patent
Smith et al.

(10) Patent No.: US 10,801,717 B2
(45) **Date of Patent: *Oct. 13, 2020**

(54) ILLUMINATED CABINET

(71) Applicant: Hafele America Co., Archdale, NC (US)

(72) Inventors: Paul K. Smith, Archdale, NC (US); Jeffery R. Ratkus, Archdale, NC (US); Lucas J. Vermeer, Archdale, NC (US); Nicholas Klietsch, Archdale, NC (US); Nina Gueorguieva, Archdale, NC (US); Ronald Mann, Archdale, NC (US)

(73) Assignee: Hafele America Co., Archdale, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/781,015

(22) Filed: Feb. 4, 2020

(65) Prior Publication Data

US 2020/0173643 A1 Jun. 4, 2020

Related U.S. Application Data

(63) Continuation of application No. 16/551,940, filed on Aug. 27, 2019, now Pat. No. 10,551,051, which is a (Continued)

(51) Int. Cl.
*F21V 33/00* (2006.01)
*F21V 23/00* (2015.01)
(Continued)

(52) U.S. Cl.
CPC ..... *F21V 33/0012* (2013.01); *A47B 97/00* (2013.01); *F21V 23/003* (2013.01); (Continued)

(58) Field of Classification Search
CPC ..... F21V 33/0012; F21V 23/003; F21V 23/0471; A47B 97/00; A47B 88/40; (Continued)

(56) References Cited

U.S. PATENT DOCUMENTS 5,580,155 A * 12/1996 Hildebrand ..... F25D 27/00 362/133
8,746,908 B2 * 6/2014 Michael ..... F21V 33/0012 362/94

(Continued)

OTHER PUBLICATIONS

Hafele Lighting Catalog, pp. 2.17-2.18 and 2.74-2.76, Jul. 2017.

*Primary Examiner* — Mary Ellen Bowman
(74) *Attorney, Agent, or Firm* — Womble Bond Dickinson (US) LLP

(57) ABSTRACT

A cabinet and a kit for retrofitting a cabinet are disclosed. The cabinet includes a stationary box, at least one moveable wing attached to the stationary box and configured to open and close relative to the stationary box. The at least one moveable wing includes at least one of a door hinged to the stationary box or a drawer mounted via slide actuators to the stationary box. The cabinet also includes a reed switch attached to the stationary box, a magnet attached to the at least one moveable wing, and at least one light emitting diode (LED) fixture installed within the stationary box. Opening the at least one wing separates the reed switch from the magnet and permits current to flow to the at least one LED fixture to illuminate at least an interior portion of the stationary box.

20 Claims, 9 Drawing Sheets

Related U.S. Application Data continuation of application No. 15/923,075, filed on Mar. 16, 2018, now Pat. No. 10,401,018.

(51) Int. Cl.

| | |
|---|---|
| ***F21V 23/04*** | (2006.01) |
| ***H05B 45/10*** | (2020.01) |
| ***H05B 45/37*** | (2020.01) |
| ***F21Y 115/10*** | (2016.01) |
| ***F21W 131/301*** | (2006.01) |
| ***A47B 97/00*** | (2006.01) |
| *A47B 88/40* | (2017.01) |

(52) U.S. Cl.

CPC ..... *F21V 23/0471* (2013.01); *H05B 45/10* (2020.01); *H05B 45/37* (2020.01); *A47B 88/40* (2017.01); *A47B 2220/0077* (2013.01); *F21W 2131/301* (2013.01); *F21Y 2115/10* (2016.08)

(58) Field of Classification Search

CPC ..... A47B 2220/0077; H05B 33/0809; H05B 33/0845; F21Y 2115/10; F21W 2131/301

See application file for complete search history.

(56) References Cited

U.S. PATENT DOCUMENTS

| | | | | |
|---|---|---|---|---|
| 9,004,717 | B2 | 4/2015 | Ratkus et al. | |
| 10,401,018 | B1 | 9/2019 | Smith et al. | |
| 10,551,051 | B2 * | 2/2020 | Smith | F21V 23/0471 |
| 2004/0080938 | A1 * | 4/2004 | Holman | G02F 1/133605 362/231 |
| 2005/0270770 | A1 * | 12/2005 | Warrender | A47B 97/00 362/157 |
| 2010/0097780 | A1 * | 4/2010 | Beatenbough | F21V 29/89 362/92 |
| 2014/0268736 | A1 | 9/2014 | Ratkus et al. | |
| 2017/0021950 | A1 * | 1/2017 | Bouthiette | A61J 1/035 |
| 2017/0284842 | A1 * | 10/2017 | Glenn | G01P 13/00 |
| 2018/0038637 | A1 * | 2/2018 | Kim | E05F 15/619 |

n

* cited by examiner

ILLUMINATED CABINET

CROSS-REFERENCE TO RELATED APPLICATION

This application is a continuation of U.S. patent application Ser. No. 16/551,940, filed Aug. 27, 2019, which is a continuation of U.S. patent application Ser. No. 15/923,075, filed Mar. 16, 2018, now U.S. Pat. No. 10,401,018. The entire contents of each of these disclosures are hereby incorporated by reference.

FIELD OF THE DISCLOSURE

The present disclosure relates to cabinetry, which includes lighting attached to the cabinet for use in kitchens, bathrooms, closets, garages, laundry rooms or other similar settings. The present disclosure also includes systems and components for providing illumination in and adjacent to cabinetry.

BACKGROUND

Interior designers and builders are increasingly incorporating lighting into their designs, within and around cabinetry. In the past, furniture case goods were one of the first items to incorporate lighting. China cabinets, book shelves, or desks sometimes included a socket for a light bulb or two. Then, the furniture piece would necessarily include a cord and a plug to be connected to a wall socket.

Unlike furniture case goods, cabinetry is more often custom designed, built, and installed as an assemblage of pieces designed on a room-by-room basis. Cabinetry is also much more likely to be installed by professionals instead of homeowners. For both manufacturers and installers, cabinetry that can be built or installed more quickly can lead to cost savings.

Today's manufacturers and installers of cabinetry are limited in their ability to sell illuminated cabinets because a significant segment of customers are not willing to pay the upcharge associated with illuminated cabinets. Illuminated cabinets are traditionally more expensive than standard cabinets because of increased component and labor costs in the manufacturing and installation processes.

Therefore, there is a need for illuminated cabinets, and a system of powering those cabinets, that can help drive down costs and increase access to illuminated cabinets by simplifying the installation and manufacturing processes.

SUMMARY

One embodiment of the present disclosure includes an illuminated cabinet. The illuminated cabinet comprises a stationary box and at least one moveable wing attached to the stationary box and configured to open and close relative to the stationary box. The at least one moveable wing includes at least one of a door hinged to the stationary box or a drawer mounted via slide actuators to the stationary box. The cabinet also includes a reed switch attached to the stationary box, a magnet attached to the at least one moveable wing, and at least one light emitting diode (LED) fixture installed within the stationary box. Opening the at least one wing separates the reed switch from the magnet, and permits current to flow to the at least one LED fixture to illuminate at least an interior portion of the stationary box.

Another embodiment of the present disclosure includes an illuminated frameless cabinet. The frameless cabinet comprises a stationary box without a face frame or stretcher bars. The frameless cabinet includes at least one moveable wing attached to the stationary box and configured to open and close relative to the stationary box. The at least one moveable wing comprises at least one of a door hinged to the stationary box or a drawer mounted via slide actuators to the stationary box. The frameless cabinet further comprises at least one light emitting diode (LED) fixture installed within the stationary box. Opening the at least one wing causes the at least one LED fixture to illuminate. The LED fixture is an elongated fixture mounted substantially horizontally within the stationary box adjacent to a front thereof. A pair of light fixture mounting brackets are arranged opposite to one another on opposite side walls of the stationary box. Each mounting bracket is an L-shaped bracket comprising a first leg for attachment to the stationary box and a second leg for attachment to one end of the elongated fixture.

Yet another embodiment of the present disclosure includes a kit for illuminating an interior of a cabinet. The kit comprises a reed switch for mounting to a stationary portion of the cabinet, a magnet for mounting to a moveable portion of the cabinet, a pair of L-shaped mounting brackets for being mounted to opposite interior walls of the cabinet, and an elongated light emitting diode (LED) fixture to be mounted between the pair of L-shaped mounting brackets.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
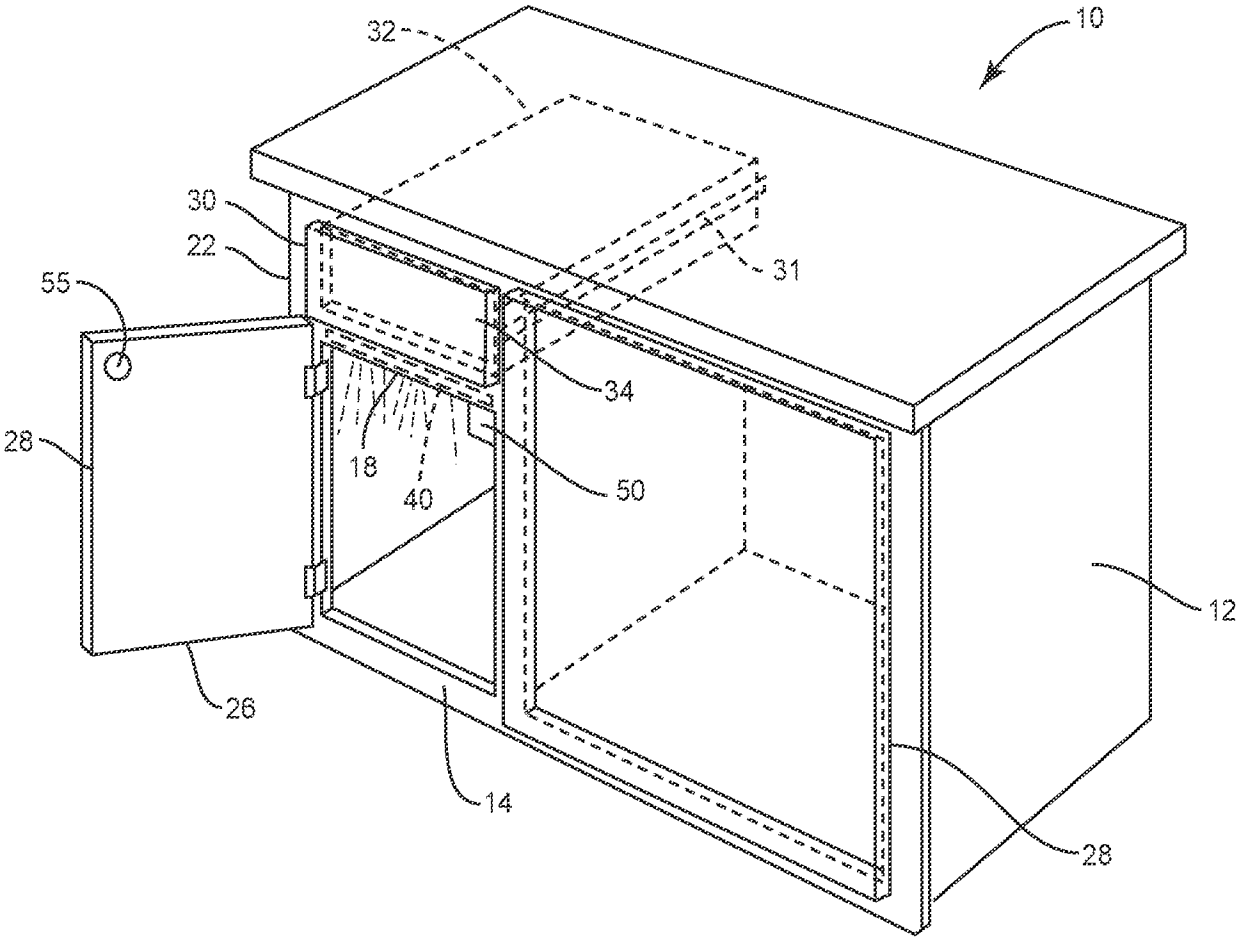
FIG. 1 illustrates a framed cabinet according to one embodiment of the present disclosure.

FIG. 1 shows a cabinet 10 with a stationary box 12. The cabinet 10 is a framed cabinet, having a face frame 14 mounted to the front of the stationary box 12. The face frame 14 may be considered part of the stationary box 12. The face frame 14 includes a stretcher bar 18 that extends horizontally between the stiles 22 of the face frame. The cabinet 10 includes at least one wing 26, which includes doors 28. As used herein, the term "wing" is used to describe any cabinet component that is configured to be moveable relative to the stationary box 12 in order to gain access to at least a portion of the interior of the stationary box. The term "wing" also applies to cabinet components that open at least a portion of the front of the stationary box 12 to gain access to storage compartments that are at least partially removed from the interior of the stationary box. Therefore, in addition to doors 28, which are traditionally understood as "wings" in the building industry, the term "wing" also includes drawers 30, particularly those with drawer fronts 34 that form a front of the cabinet 10 in a closed position. In other embodiments, interior drawers that do not form a front of the cabinet may be considered "wings" if motion of those drawers corresponds with operation of a light fixture.

Figure 3:
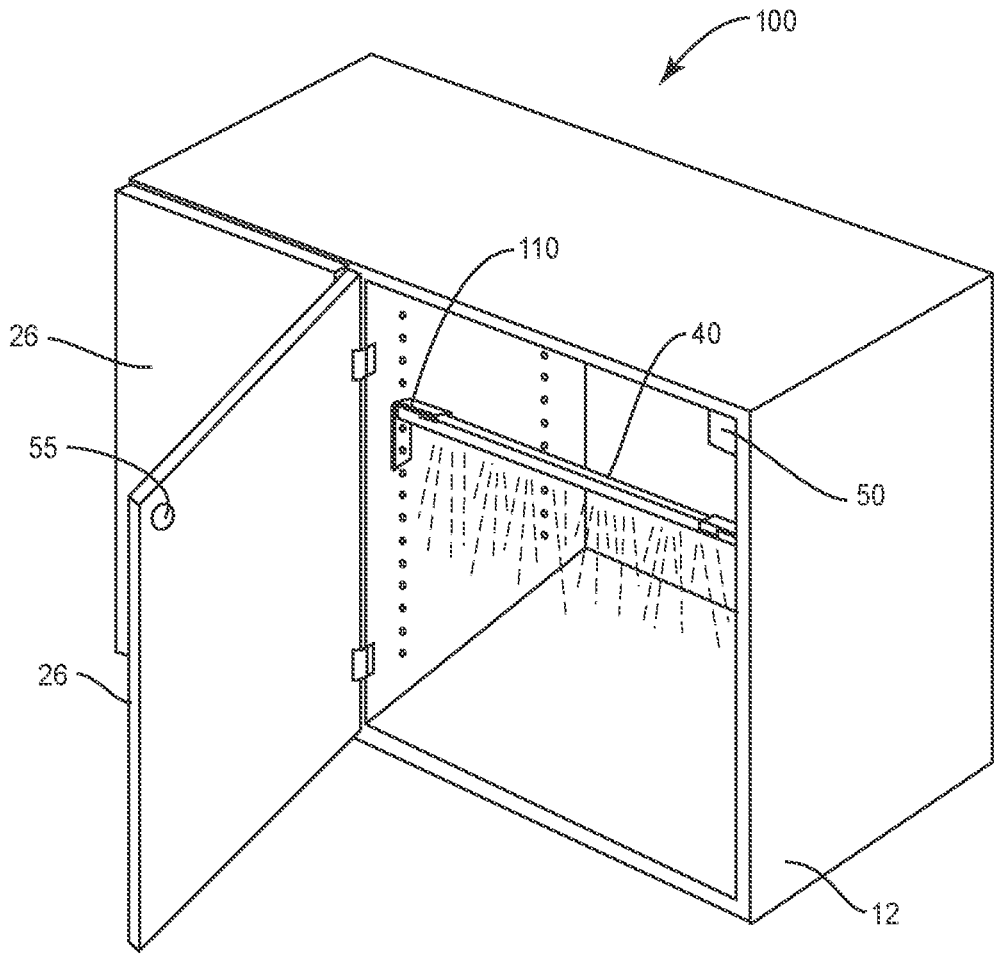
FIG. 3 shows a frameless cabinet according to another embodiment of the present disclosure.

The cabinet 10 of FIG. 1 includes three wings 26 illustrated in the form of two doors 28 and a drawer 30, which may be installed via slide actuators 31 to the interior of the cabinet. The cabinet 10 includes at least one light emitting diode (LED) fixture 40 installed within the stationary box 12, such as attached to the rear of the stretcher bar 18, to illuminate at least an interior portion of the stationary box. LED fixture 40 is also shown in FIG. 3. Optionally, the cabinet 10 may include at least one additional LED luminaire 45 (see FIGS. 5A and 5B) attached to an exterior of the stationary box 12 to provide functionality such as uplighting, under cabinet lighting, or toe-kick illumination.

In one embodiment, shown in FIG. 1, the cabinet 10 includes a reed switch 50. In one embodiment, the reed switch 50 is the normally-on type, also referred to as a normally-closed type. The normally-closed reed switch 50 may be advantageous to allow the reed switch to act as a load carrying component and simplify any control circuitry associated with the reed switch. In potentially less preferred embodiments, the reed switch 50 can be a normally-open type. As known in the art, a reed switch 50 includes at least two contacts, at least one of which comprises a ferromagnetic material. In the presence of the magnetic field generated by a magnet 55, the contacts are polarized to be either attracted to one another and close a circuit of a normally-open switch, or the contacts are polarized so the contacts repel one another to open the circuit of a normally-closed switch.

The reed switch 50 can be attached to a portion of the stationary box 12, for example, the face frame 14. The magnet 55 is attached to the at least one moveable wing 26. When the respective wing 26 is in a closed position, the magnet 55 is mounted to be in close proximity, such as within about two inches, to the reed switch 50. Using the reed switch 50, the act of opening the at least one wing 26 separates the magnet 55 from the reed switch 50 to trigger illumination of the LED fixture 40. In the case of a normally-closed reed switch, separating the reed switch from the magnet 55 permits current to flow to the at least one LED fixture 40 directly through the reed switch.

In one embodiment, as shown in FIG. 1, the magnet 55 is attached to a door 28 and the reed switch 50 is attached to the face frame 14. In another embodiment (not shown), the magnet 55 can be attached to a rear of a drawer box 32 and the reed switch 50 can be mounted to a rear wall of the stationary box 12. Hiding the magnet 55 may be preferred. Therefore, the magnet 55 may be preferably attached to the drawer box 32 at a location other than the drawer front 34. The magnet 55 may be on a bottom of the drawer box 32 or on the back side of the drawer box that is sufficiently rearward of the drawer front 34 to remain within the interior of the stationary box 12 when the drawer 30 is fully pulled out.

Figure 2:
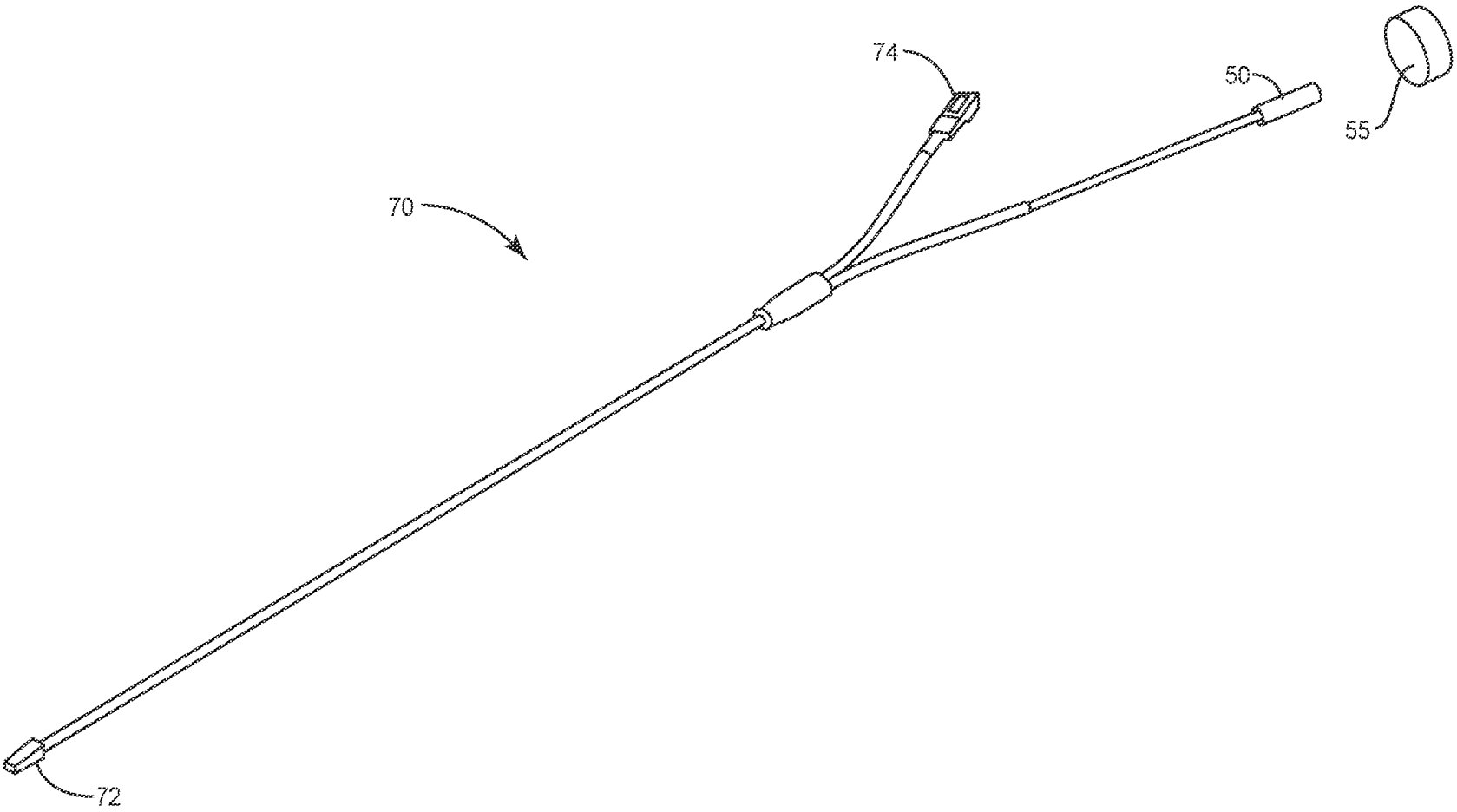
FIG. 2 shows a wiring harness with a reed switch according to an embodiment of the present disclosure.

FIG. 2 shows one embodiment where the reed switch 50 is integrated into a wiring harness 70 with a male plug 72 spaced from a female plug 74. The wiring harness 70 may create an arrangement in the shape of a "Y" as shown with the female plug 74 and the reed switch 50 at the distal ends of the top arms of the harness. The Y-configured harness 70 may be preferred in order to create an assembly that is comprised of a power input segment, a power output segment, and a control segment. The control segment should have sufficient length to position the reed switch 50 away from the power input segment and the power output segment. Positioning the reed switch 50 away from the power input and output segments allows the reed switch to be freely located and positioned to optimize actuation upon opening of a hinged door or sliding of a drawer.

The reed switch 50, used in combination with a magnet 55, is preferred over mechanical plunger-type switches, which are often used with wings on devices such as refrigerators and clothes dryers. The reed switch 50 is preferred because mechanical plungers rely on direct contact to provide a pressing force on the plunger. Direct contact could be interrupted if used in cabinetry because the door 28 of a cabinet 10 could experience warpage caused by the effect of humidity on the door material, which is typically wood or a wood product. The door 28 of a cabinet 10 could also experience door sag caused by weak or misaligned hinges, or door-to-cabinet separation caused by hinge misalignment, or material interference such as the application of door bumpers. Additionally, drawers can experience slide misalignment causing "racking," i.e., sideways movement of the drawer box with respect to the cabinet interior, or material interference such as the application of drawer bumpers to the face of the drawer box. Reed switches 50 do not require direct physical contact between the switch and the magnet 55, maintaining reliability where plungers may fail. In addition, the use of a reed switch 50 introduces additional tolerances into the process of assembling a cabinet 10 because the reed switch and magnet do not require precise alignment.

Further, unlike reed switches used as a sensor such as found in an alarm system or the like which transmit a signal, state, or condition back to a central processing unit, the reed switch 50 of the present disclosure may act as a power transmission device relying on its ability to break or close an electrical circuit to directly supply or restrict electrical power to an LED load with the intent of lighting cabinetry. In other words, in some embodiments, the electrical current path passes exclusively through the reed switch to the LED load.

Figure 4B:
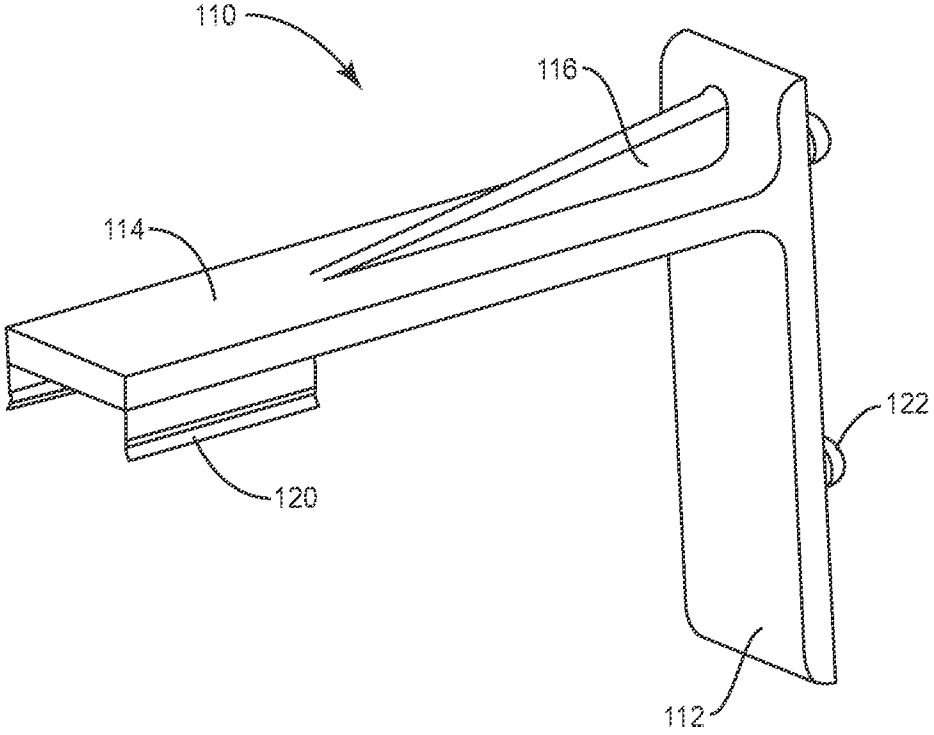
FIGS. 4A and 4B show detailed views of a mounting bracket according to a pair of embodiments of the present disclosure.
Figure 4A:
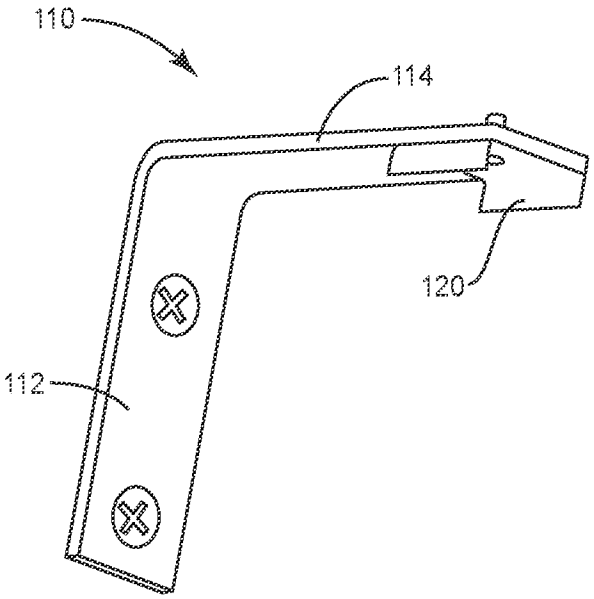

FIG. 3 shows an alternative cabinet 100 commonly referred to as a frameless cabinet because a face frame is not used. Often, in a framed cabinet 10 as shown in FIG. 1, the LED fixture 40 is mounted to a horizontal member such as the stretcher bar of the cabinet 10. In order to mount an LED fixture 40 to the interior of the frameless cabinet 100, particularly an elongated, horizontally mounted LED fixture, the inventors have developed a light fixture mounting bracket 110. One skilled in the art will appreciate that the light fixture mounting bracket 110 may be applicable to the framed cabinet 10 (FIG. 1) as well. As possibly best shown in FIGS. 4A and 4B, the light fixture mounting bracket 110 may be generally referred to as an L-shaped bracket, with a first leg 112 for attachment to the stationary box 12, and a second leg 114 for attachment to the LED fixture 40, as shown in FIG. 3. As shown in the illustrated embodiment of FIG. 4B, the mounting bracket 110 may be considered L-shaped even if the first and second legs 112, 114 do not intersect at the distal ends thereof. The illustrated embodiment of FIG. 4B includes a reinforcing rib 116 to add strength to the cantilevered second leg 114. In one embodiment, a clip 120 is attached to the second leg 114 for joining the LED fixture 40 to the mounting bracket 110. Particularly, the clip 120 may be placed on the underside of the second leg 114, on the side of the second leg corresponding with a majority of the length of the first leg 112. The embodiment of FIG. 4A shows fasteners, e.g. screws, provided for use in securing the first leg 112 to the cabinet. The embodiment of FIG. 4B shows an alternative design with integrated dowels 122 used for press fitting the mounting bracket 110 into preformed holes along the side walls of the cabinets, such as 32 mm system holes common in the art. The clip 120 can be a separate component secured to either bracket 110 in FIG. 4A or FIG. 4B. Therefore, the configuration of the clip 120 can be selected based upon the configuration of the LED fixture 40 without otherwise modifying the brackets 110.

As possibly best seen in FIG. 3, in one embodiment, the LED fixture 40 is an elongated fixture for mounting horizontally between the side walls of the stationary box 12, near a front of the stationary box. In most embodiments, the LED fixture 40 would be supported by a pair of the mounting brackets 110, which may preferably be identical to one another. The pair of mounting brackets 110 could be arranged opposite to one another on opposite side walls of the stationary box 12 with the second leg 112 of each mounting bracket extending toward one another. Therefore, especially in the frameless cabinet 100, the mounting brackets 110 significantly simplify attachment of an elongated LED fixture 40 into a cabinet in a horizontal manner for illuminating the interior of a stationary box. The mounting brackets 110 are able to quickly be attached to the sides of the stationary box 12 through the one or more dowels 122 on the first leg 112. Additional assembly time can be saved by using an identical mounting bracket 110 on each side of the cabinet 100, and the LED fixture 40 can quickly clip into the pair of mounting brackets.

Additionally, in one embodiment, attachment of the mounting clip 120 to the substantially horizontal second leg 114 of each bracket 110 in FIG. 4A or FIG. 4B can allow the mounting clip to rotate. This ability to rotate can enable a pair of brackets 110 to further compensate for minor installation misalignment between the brackets in both lateral and vertical planes with respect to each other.

Figure 5A:
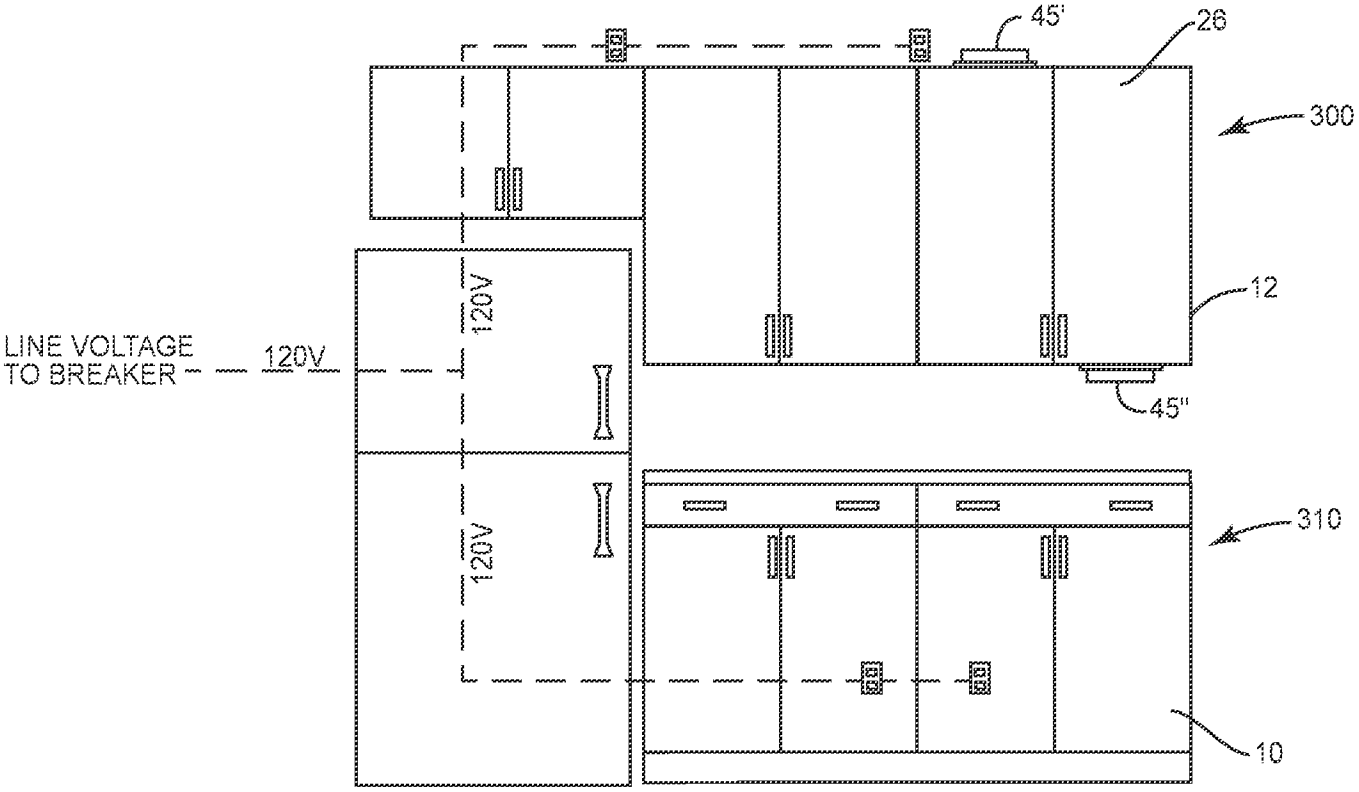
FIGS. 5A and 5B show a kitchen with several cabinets according to embodiments of the present disclosure.
Figure 5B:
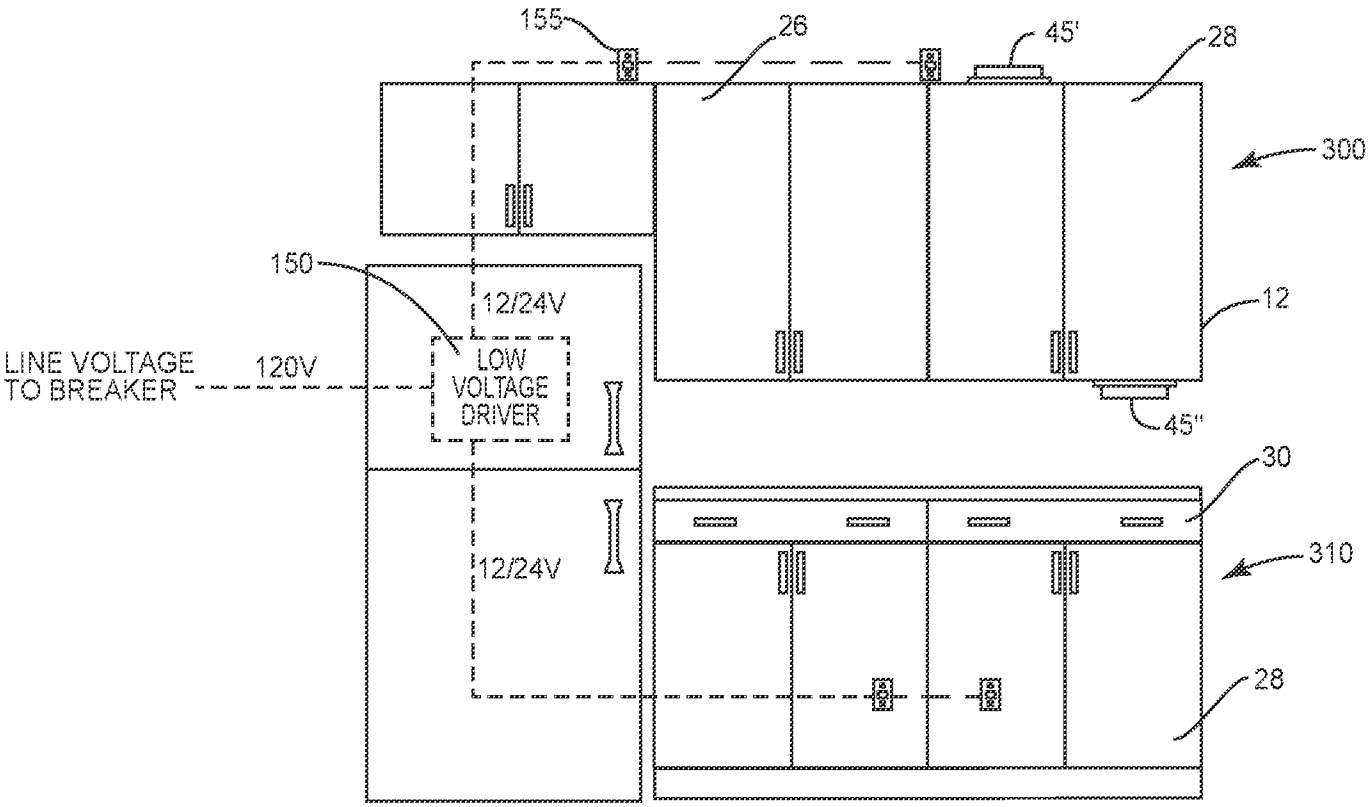

As mentioned above, cabinets 10, 100 are often found in sets. FIGS. 5A and 5B show a much more typical room design, such as a kitchen, with several cabinets 10 (or cabinets 100) of various types and locations. The cabinets 10 may be floor cabinets, wall cabinets with space above, or wall cabinets that rise all the way to a ceiling. The cabinets 10 may present a combination of drawer front and door front types. Each cabinet may have one or more LED fixture on the inside for emitting light at least partially within the interior of the respective stationary box of each cabinet. Each cabinet may also have one or more exterior LED luminaire 45 to provide up lighting, under cabinet lighting, or floor lighting.

To improve the manufacturing and installation processes of cabinets used in groups, the present disclosure further contemplates an improved power distribution system. The light sources primarily contemplated by the present disclosure employ light emitting diodes (LEDs), which typically operate with direct current (DC). LED light sources are typically used in combination with an AC/DC converter commonly referred to as a driver. Previously, each light fixture, or each cabinet, would be provided with their own driver, which would receive power from a standard 120 v wall socket as shown in FIG. 5A. The prior wiring method was often expensive because of the use of multiple drivers. In addition, drivers are often much larger than the LED emitter portion of light fixtures, resulting in packaging constraints if the drivers were to be built into the light fixtures themselves. In other known methods, a single driver may have been used to power the light fixtures of several cabinets, but the electrical components associated with each cabinet had to be separately wired back to the single driver. This approach made the wiring set up very time consuming, and could lead to a bundle of disorganized wires.

FIG. 5B illustrates an alternative wiring arrangement that includes a low voltage driver 150 that can be wired to a home's line voltage. The driver 150 can be housed in a discreet yet accessible location, such as a cavity built into the wall behind a refrigerator. Wires can then be run from the driver 150 to low voltage sockets 155 provided adjacent to cabinet locations.

Figure 6A:
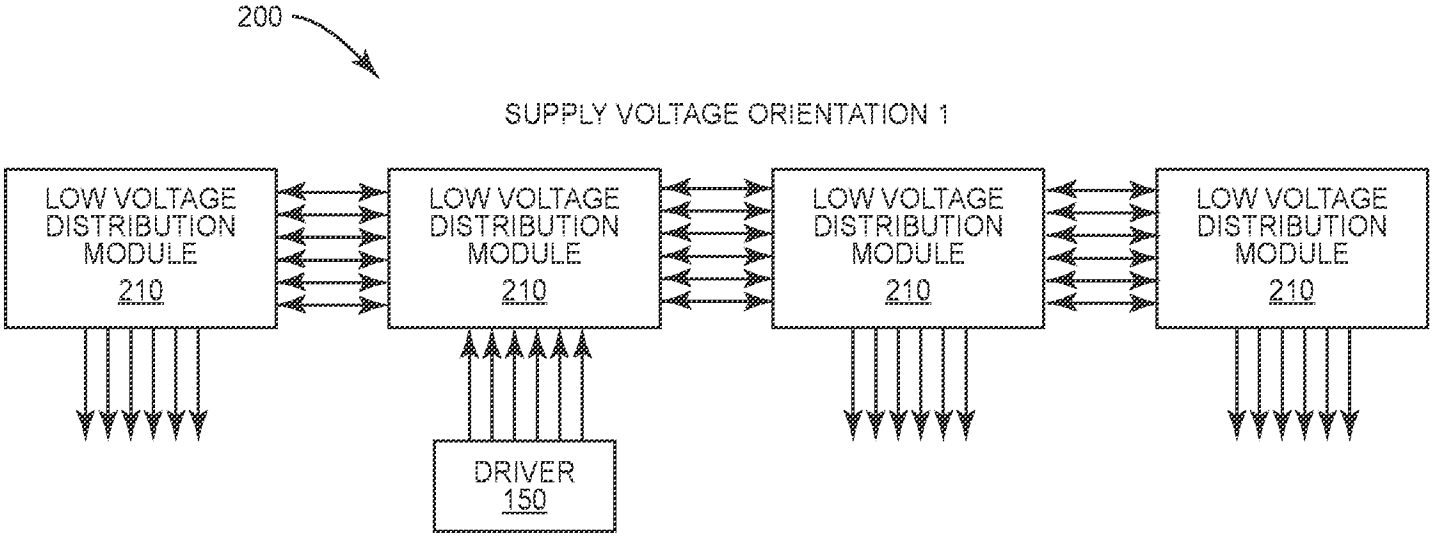
FIGS. 6A and 6B schematically illustrate alternative power distribution patterns according to embodiments of the present disclosure.
Figure 6B:
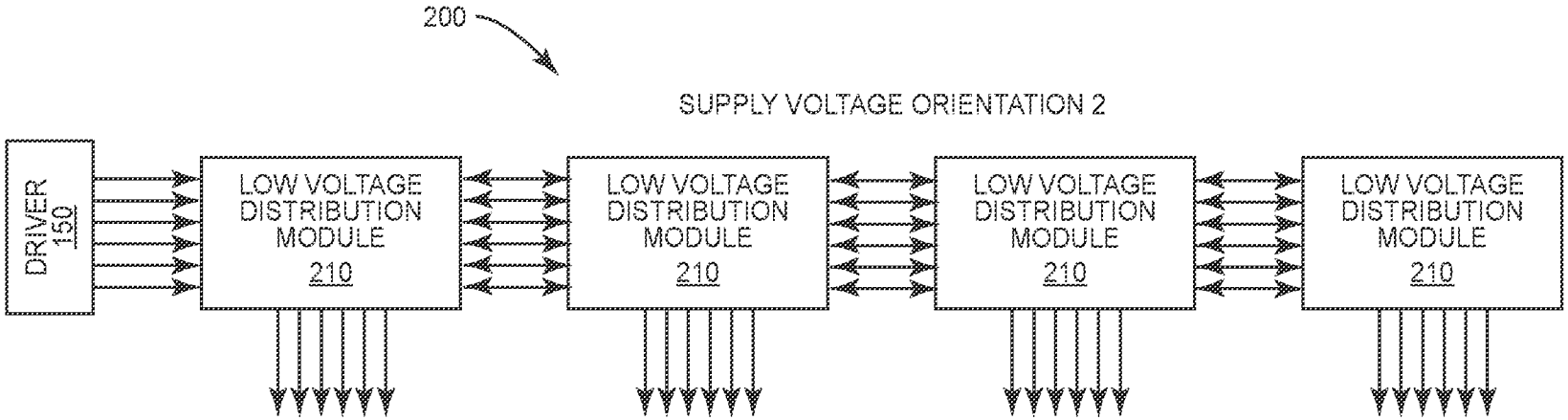

In another embodiment, an alternative power distribution system 200, shown in FIGS. 6A and 6B, relies upon a plurality of signal distribution modules 210 in combination with a single driver 150. FIGS. 6A and 6B schematically illustrate two embodiments of the power distribution system 200. The illustrated power distribution systems 200 may be beneficial to existing building construction because the signal distribution modules 210 can be incorporated into the cabinets 10, 100 instead of the wall sockets.

Figure 7:
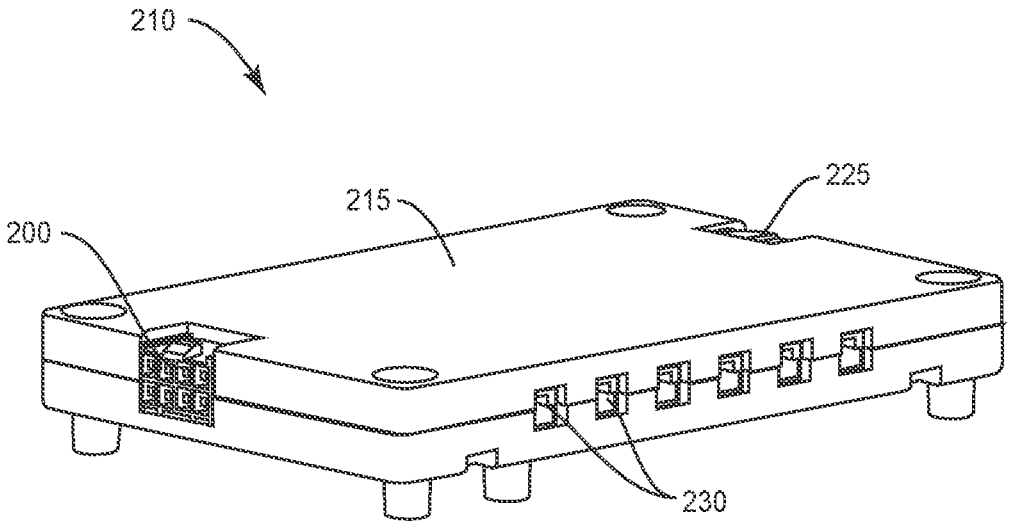
FIG. 7 illustrates an exemplary power distribution module.
Figure 8:
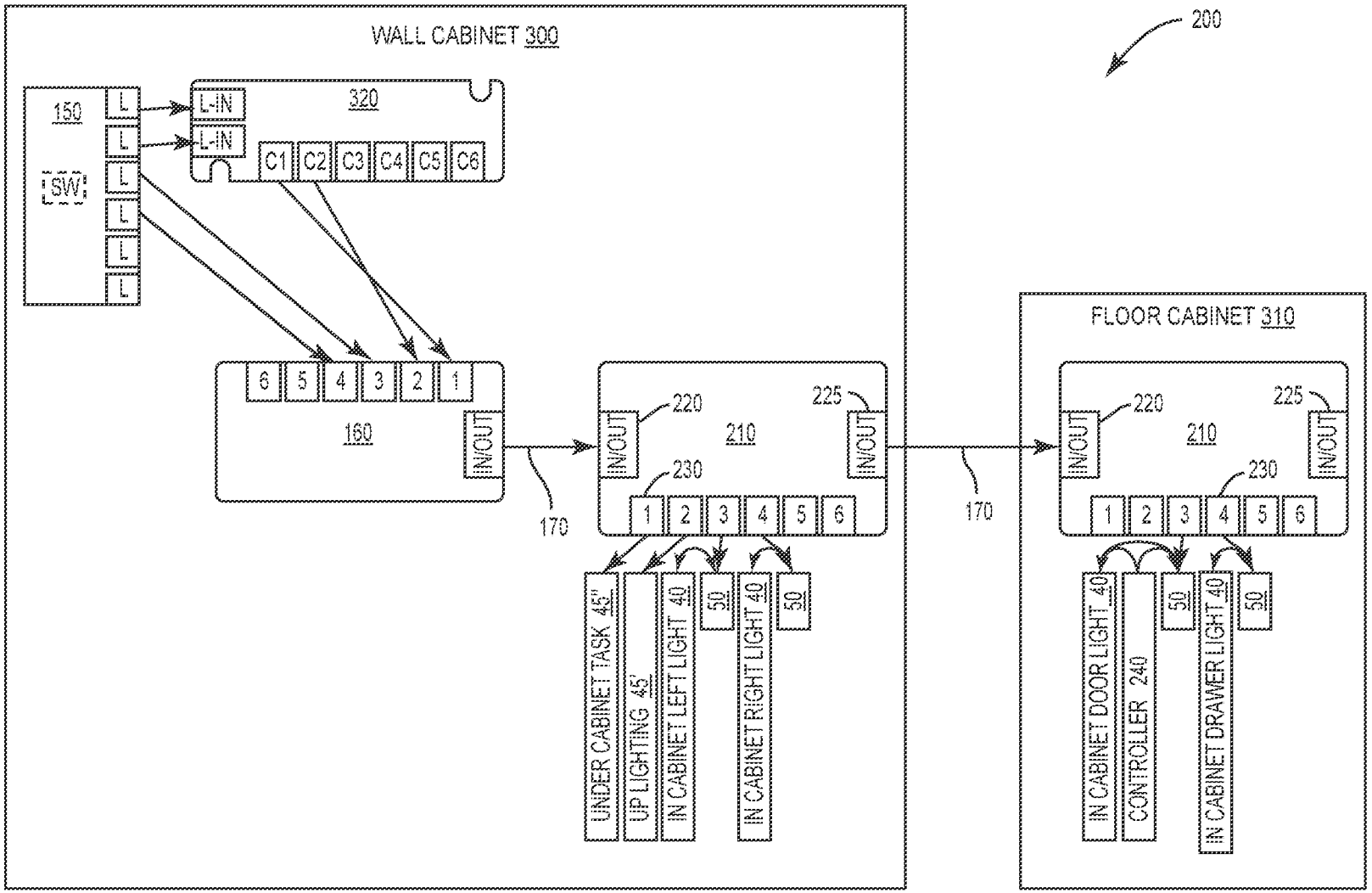
FIG. 8 schematically illustrates an exemplary system for distributing power to the light sources inside and outside the cabinets of FIG. 5B.

FIG. 7 illustrates an example signal distribution module 210. The signal distribution module 210 is configured to achieve at least two functions. First, the signal distribution module 210 acts as a hub for receiving several signals and distributing those signals to a plurality of LED light sources 40, 45 associated with a respective cabinet. Second, the signal distribution module 210 provides a pass-through of the input signals to the next downstream signal distribution module. Preferably, the signal distribution module 210 is packaged in a single housing 215. The signal distribution module 210 includes a master input port 220, a master output port 225, and a plurality of circuit connectors 230. In one embodiment, the signal distribution module 210 includes six circuit connectors 230 configured to distribute up to six separate signals received from the driver 150 (FIG. 8). The signal distribution module 210 is not limited to six circuit connectors 230, but preferably includes at least two. In a preferred embodiment, the number of circuit connectors 230 is equal to the number of signal outputs available from the single driver 150.

The master input port 220 is configured to be capable of simultaneously receiving a first quantity of signals n through a single connector, where n is equal to the number of circuit connectors 230 in the signal distribution module 210. The master output port 225 is configured to be capable of simultaneously transmitting n signals through a single connector, where n is equal to the number of circuit connectors 230 in the signal distribution module 210. Thus, the signal distribution module 210 facilitates a pass-through from the master input port 220 to the master output port 225.

As shown in FIG. 8, the driver 150 may include six output channels. An adaptor 160 may be used to adapt from six separate output ports to a single multi-signal connector configured to engage with the master input port 220 of a first signal distribution module 210. A multi-signal transmission cable 170 may then bridge the distance from the adaptor 160 to the master input port 220 of the signal distribution module 210. A second multi-signal transmission cable 170 may then bridge the distance from the master output port 225 of the signal distribution module 210 of a first cabinet, such as a wall cabinet 300, to the signal distribution module 210 of a second, adjacent cabinet, such as a floor cabinet 310.

From this description, it can be seen that the multiple signals available from the driver 150 can be passed from cabinet to cabinet in series using a single multi-signal transmission cable 170 per cabinet when each cabinet is provided with a signal distribution module 210. Therefore, the need to connect each cabinet, or each LED light source 40, 45, to the driver 150 individually can be avoided. Further, each circuit connector 230 of the signal distribution module 210 can be operably connected to separate functioning light sources 40, 45 associated with each cabinet. Therefore, for example, a manufacturer may attach the signal distribution module 210 to the stationary box 12 (FIG. 1) of the cabinet 10, and connect each of the LED fixtures 40 and LED luminaires 45 into their appropriate circuit connector 230 on the signal distribution module 210 prior to shipping the cabinet. Then, at the jobsite, the installer can simply attach a multi-signal transmission cable 170 between pairs of signal distribution modules 210 after the cabinets 10, 100 have been installed.

In one embodiment, a controller 240 (see FIG. 8) may be included in operational communication with the reed switch 50 and the at least one LED fixture 40. The controller 240 can be configured to cause gradual illumination of the LED fixture 40 when the magnet 55 is initially separated from the reed switch 50. The concept of gradual illumination is the result of a programmed power ramp up in the supplied voltage. In one example, this ramp up begins at about 50% of full operating voltage. The ramp may take between about one and about two seconds to reach full voltage. The result is a gradual increase in light intensity as compared to an abrupt full illumination initially. In some embodiments, particularly if a normally-closed reed switch is used, the same concept can occur when power is interrupted. Light intensity may decrease from full voltage down to about 50% before cutting off all together. This arrangement may be advantageous for cabinets with transparent or translucent doors, where the illumination can still be perceived when the door is closed.

The signal distribution system 200, of which one embodiment is illustrated in FIG. 8, is not limited to arrangements located external to the walls of a room, but may alternatively be built in. For example, each signal distribution module 210 may be mounted in the wall, with the signal connectors 230 forming the exposed sockets 155 (FIG. 5B). Cables, such as multi-signal transmission cables 170, may pass between signal distribution modules 210 through the wall.

One example of a power distribution system 200 is schematically illustrated in FIG. 8 with reference to the arrangement of cabinets in FIG. 5B. The exemplary power distribution system 200 is illustrated with a wall cabinet 300. The wall cabinet 300 may have an upward emitting LED luminaire 45' and a downward emitting LED luminaire 45". The wall cabinet 300 is illustrated in FIG. 5B with a pair of doors 28, which may be able to activate respective left and right LED fixtures 40 installed within the wall cabinet. The exemplary power distribution system 200 also includes a floor cabinet 310, with a door 28 configured to control operation of an LED fixture 40 within the cabinet and a drawer 30 configured to control operation of another LED fixture 40 within the cabinet, each through the use of a reed switch 50 as discussed above.

FIG. 8 illustrates a driver 150 with six distribution channels, though not all of the available channels are in-use for the example power distribution system 200. An optional switch 320 is shown interfacing with two of the channels of the driver 150. The switch 320 may be a wall switch or other known type of switch, such as a remotely controlled switch, which could interface with Wi-Fi. In the illustrated example, the upward emitting LED luminaire 45' and the downward emitting LED luminaire 45" are wired to channels of a respective power distribution module 210 of the wall cabinet 300 that correspond with the switch 320. As such, turning on and off the upward and downward emitting LED luminaires 45', 45" is facilitated through the switch 320. By using separate signal channels from the driver 150, the upward and downward emitting LED luminaires 45', 45" can be controlled independently.

FIG. 8 further schematically illustrates the adaptor 160 used to interface between the driver 150 and a multi-signal transmission cable 170, which leads to the master input port 220 of the power distribution module 210 of the wall cabinet 300. Two of the signal connectors 230 of the power distribution module 210 that correspond with the switch 320 lead to the upward and downward emitting LED luminaires 45', 45" respectively. In addition, the LED fixtures 40 are operably connected to two other channels of the power distribution module 210 via reed switches 50 and separate signal connectors 230. The two channels corresponding with the two signal connectors 230 that lead to the two LED fixtures 40 may be continuously receiving voltage from the driver 150. The LED fixtures 40 would then turn on and off based upon the operation of the reed switch 50 and proximity of the magnet 55 (FIG. 1) thereto, based upon motion of the respective wing 26 of the cabinet. One or both of the two LED fixtures 40 may also include a controller 240 as discussed above.

Continuing with the schematic of FIG. 8, the power distribution module 210 of the floor cabinet 310 is connected to the power distribution module 210 of the wall cabinet 300 with a multi-signal transmission cable 170. Thus, as described above, the power distribution module 210 of the floor cabinet 310 receives the same set of signals as the power distribution module 210 of the wall cabinet 300. The power distribution module 210 of the floor cabinet 310 is wired to two LED fixtures 40, each via a reed switch 50 in the illustrated example.

Other power distribution arrangements and lighting component operations will be apparent to those of ordinary skill in the art. For example, a splitter may be inserted between one of the signal connectors 230 and multiple LED light sources 40, 45 that are intended to function together. For example, movement of a door may lead to operation of multiple light sources, such as one light source per shelf within a cabinet. Other light sources may be installed within a cabinet to be operated independent of the movement of the door. If a cabinet door is transparent, for example, lighting may be desired within the cabinet to display to contents of the cabinet, where the lighting is not operated solely as a result of opening the door.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed:

1. A power distribution module comprising:

a housing configured to be incorporated into at least one of a box or a cabinet, the housing having a first edge, a second edge, and a third edge, the second edge opposite the first edge, the third edge extending between the first and second edges;

an input port defined in the first edge of the housing, the input port having a plurality of discrete input channels, the input port configured to receive a multi-signal connector to electrically couple the power distribution module to a source of energy;

an output port defined in the second edge of the housing, the output port having a plurality of discrete output channels with each output channel of the plurality of discrete output channels in electrical communication with a single input channel of the plurality of discrete input channels, the output port configured to receive a multi-signal connector to electrically couple the power distribution module to a power distribution module of another cabinet; and a circuit port defined in the third edge of the housing, the circuit port having a plurality of discrete circuit connectors with each circuit connector in electrical communication with a single input channel of the plurality of discrete input channels and a single output channel of the plurality of discrete output channels.

2. A power distribution system comprising:

a first power distribution module comprising:

a first housing configured to be incorporated into at least one of a first box or a first cabinet, the first housing having a first edge, a second edge, and a third edge, the second edge opposite the first edge, the third edge extending between the first and second edges;

an first input port defined in the first edge of the first housing, the first input port having a plurality of discrete input channels, the first input port configured to receive a multi-signal connector to electrically couple the first power distribution module to a source of energy;

an first output port defined in the second edge of the first housing, the first output port having a plurality of discrete output channels with each output channel of the plurality of discrete output channels in electrical communication with a single input channel of the plurality of discrete input channels; and a first circuit port defined in the third edge of the first housing, the first circuit port having a plurality of discrete circuit connectors with each circuit connector in electrical communication with a single input channel of the plurality of discrete input channels and a single output channel of the plurality of discrete output channels;

a second power distribution module comprising:

a second housing configured to be incorporated into at least one of a second box or a second cabinet, the second housing having a first edge, a second edge, and a third edge, the second edge opposite the first edge, the third edge extending between the first and second edges;

an second input port defined in the second edge of the second housing, the second input port having a plurality of discrete input channels;

an second output port defined in the second edge of the second housing, the second output port having a plurality of discrete output channels with each output channel of the plurality of discrete output channels in electrical communication with a single input channel of the plurality of discrete input channels; and a second circuit port defined in the third edge of the second housing, the second circuit port having a plurality of discrete circuit connectors with each circuit connector in electrical communication with a single input channel of the plurality of discrete input channels and a single output channel of the plurality of discrete output channels; and a first multichannel interconnector connected at a first end to the first output port and at a second end opposite the first end to the second input port to electrically couple each input channel of the first input port with a single output channel of the second output port.

3. The power distribution system according to claim 2, further comprising:

a first light source connected to a first circuit connector of the first circuit port, the first circuit connector of the first circuit port electrically coupled to a first channel of the first and second input ports;

a second light source connected to a first circuit connector of the second circuit port, the first circuit connector of the second circuit port electrically coupled to the first channel;

a first switch remote to the first and second housings and in electrical communication with the first channel having an activated mode in which energy is provided to the first channel such that illumination of the first and second light sources is activated and a deactivated mode in which illumination of the first and second light sources is deactivated.

4. The power distribution system according to claim 3, further comprising:

a third light source electrically coupled to a second circuit connector of the first circuit port, the second circuit connector of the first circuit port electrically coupled to a second channel of the first and second input ports;

a fourth light source electrically coupled to a second circuit connector of the second circuit port, the second circuit connector of the second circuit port electrically coupled to the second channel;

a second switch connected between the fourth light source and the second circuit connector of the second circuit port, the second switch configured to activate and deactivate illumination of the fourth light source; and a third switch connected between the third light source and the second circuit connector of the first circuit port, the third switch configured to activate and deactivate illumination of the third light source independent of the illumination of the fourth light source.

5. The power distribution system according to claim 2, further comprising a driver electrically coupled to each input channel of the first input port and configured to provide electrical energy to each input channel independent of the other input channels.

6. The power distribution system according to claim 5, further comprising a first switch remote to the first and second housings and in electrical communication with a first channel of the driver, the first switch having an activated mode in which the first switch provides energy to a first channel of the first and second input ports and a deactivated mode in which the first switch prevents energy delivery to the first channel of the first and second input ports.

7. The power distribution system according to claim 6, wherein the first switch is configured to simultaneously control illumination of a first light source connected to the first circuit port and a second light source connected to the second circuit port.

8. The power distribution system according to claim 6, wherein the driver has a second channel electrically coupled to a second channel of the first and second input ports and configured to provide constant energy through the second channel.

9. The power distribution system according to claim 8, further comprising a first light source in selective electrical communication with the second channel and a second light source in selective electrical communication with the second channel independent of the first light source.

10. The power distribution system according to claim 9, wherein the first light source is in selective electrical communication with the first circuit port and the second light source is in selective electrical communication with the second circuit port.

11. The power distribution system according to claim 5, further comprising:

a first box, the first housing mounted within the first box; and a second box, the second housing mounted within the second box.

12. The power distribution system according to claim 11, wherein the driver is mounted remote to the first and second boxes.

13. A power distribution system comprising:

a driver;

a first power distribution module having a first housing, the first housing configured to be mounted to a first cabinet or a first box;

a second power distribution module having a second housing, the second housing configured to be mounted to a second cabinet or a second box, the second power distribution module coupled to the first power distribution module, the second power distribution module configured to receive energy from the driver via the first power distribution module;

a discrete first power channel extending from the driver, through the first power distribution module, and the second power distribution module;

a second discrete power channel extending from the driver, through the first power distribution module, and the second power distribution module, the driver configured to provide constant energy to the second power channel.

14. The power distribution system according to claim 13, further comprising:

a first switch disposed in the first power channel between the driver and the first power distribution module, the first switch having an activated mode in which energy is provided to the first power channel and a deactivated mode in which energy delivery to the first power channel is prevented.

15. The power distribution system according to claim 14, further comprising:

a first light source directly connected to the first housing and electrically coupled to the first channel; and a second light source directly connected to the second housing and electrically coupled to the first channel, illumination of the first and second light sources each controlled by the first switch.

16. The power distribution system according to claim 15, further comprising:

a third light source electrically coupled to the second channel; and a fourth light source electrically coupled to the second channel, illumination of the third and fourth light sources controlled independent of one another.

17. The power distribution system according to claim 16, wherein the third light source is installed is connected to the first housing and the fourth light source is connected to the second housing.

18. The power distribution system according to claim 17, wherein illumination of the third light source is controlled by a second switch directly connected to the first housing between the first housing and the third light source, and wherein illumination of the fourth light source is controlled by a third switch installed directly connected to the second housing between the second housing and the fourth light source.

19. The power distribution system according to claim 13, further comprising:

a first box, the first housing mounted within the first box; and a second box, the second housing mounted within the second box.

20. The power distribution system according to claim 19, wherein the driver is mounted remote to the first and second boxes.

* * * * *